United States Patent [19]

Ohta

[11] Patent Number: 4,955,299

[45] Date of Patent: Sep. 11, 1990

[54] WEB PRINTING PRESS WITH REPLACEABLE PRINT UNIT

[75] Inventor: Hirotake Ohta, Kanagawa, Japan

[73] Assignee: Taiyo Kikai Ltd., Tokyo, Japan

[21] Appl. No.: 438,243

[22] Filed: Nov. 20, 1989

Related U.S. Application Data

[63] Continuation of Ser. No. 182,348, Apr. 18, 1988, abandoned.

[30] Foreign Application Priority Data

Sep. 9, 1987 [JP] Japan ..... 62-224059

[51] Int. Cl.[5] ..... B41F 7/04; B41F 7/12; B41F 31/30

[52] U.S. Cl. ..... 101/143; 101/182; 101/352

[58] Field of Search ..... 101/137–140, 101/142, 143, 144, 145, 148, 177, 178–182, 184, 219–225, 228, 229, 231, 207–210, 247, 351, 352

[56] References Cited

U.S. PATENT DOCUMENTS

| | | | |
|---|---|---|---|
| 3,147,700 | 9/1964 | Martin | 101/218 |
| 3,470,816 | 10/1969 | Piecha et al. | 101/220 X |
| 3,774,537 | 11/1973 | Christoff | 101/218 |
| 4,616,564 | 10/1986 | Faddis et al. | 101/218 |

*Primary Examiner*—J. Reed Fisher

*Attorney, Agent, or Firm*—Goodman & Teitelbaum

[57] ABSTRACT

A blanket to blanket Typed Printing Press for separately using, one at a time, a plurality of printing units each of which includes two sets of plated and blanket cylinders, where one printing unit has different standard sizes of cylinders with respect to another printing unit, and a pair of ink feeding units. Each printing unit, being disposed between the ink feeding units is replaceable and the space inbetween each of the ink feeding units, is controlable so as to feed adequately the ink required for each portion of the printing unit.

10 Claims, 2 Drawing Sheets

WEB PRINTING PRESS WITH REPLACEABLE PRINT UNIT

This is a continuation of application Ser. No. 182,348, filed Apr. 18, 1988, now abandoned.

BACKGROUND OF THE INVENTION (1) Field of the Invention

The present invention relates to a printing press utilizing an offset or form printing and the like, and more particularily a Blanket to Blanket Typed Printing Press, commonly known as and hereinafter referred to as a 'B-B typed Printing Press' which simultaneously prints both surfaces of the web(s) fed from the paper roll(s) passing between blanket cylinders.

(2) Description of the Prior Arts

A B-B Typed Printing Press is widely utilized in printing a page of photogravure, in business form or leaflet etc, for the reason that the plate attachment is simple, the resulting precision color printing is good, and the device can be made compact etc.

However, dimensions of the plated and blanket cylinders are predetermined, and, accordingly, the dimension of printing paper thereof is limited. Therefore, it was heretofore difficult as well as inconvenient to rapidly print paper of different sizes since it was necessary to utilize another printing press which is had plated and blanket cylinders with the required dimension.

Recently known is a Vanicolor (trademark) series, printing press which is manufactured and sold by GOEBEL A.G. in West Germany and is capable of accommodating various sizes of printing paper. In this printing press two sets of plated and blanket cylinders exist as one complete unit in which this unit has predetermined dimensions and may be replaced. The ratio of the diameter of the blanket cylinder to the plated cylinder must be constructed in such a manner as to be in any whole integer. Furthermore, a pair of blanket cylinders are disposed in close proximity to each other so that each of the plated cylinders is connected respectively with each of the ink feeding units affixed in a stationary position.

As the distance between the pair of ink feeding units is predetermined and stationary, if a small sized plated cylinder is to be utilized, the blanket cylinder would be too large and, accordingly, both cannot be attached as a unit to the device. Alternatively, when making the plated cylinder larger, the blanket cylinder must also be larger to correspond with the plated cylinder. Therefore, the sizes of both cylinders were naturally limited.

SUMMARY OF THE INVENTION

The present invention is proposed to provide a B-B Typed Printing Press wherein plated and blanket cylinders always have the same dimensional ratio and thereby the plates having different sizes can be utilized. As a result uneven density of color printing rarely occurs, and work efficiency of register and replacement of the plate is improved.

A B-B Typed Printing Press of the present invention can separately use, one at a time, a plurality of printing units each of which includes two sets of plated and blanket cylinders, where one printing unit has different standard sizes of cylinders with respect to another printing unit, and a pair of ink feeding units. Each printing unit being disposed between the ink feeding units, is replaceable and the space inbetween each of the ink feeding units is controlable so as to feed adequately the ink required for each portion of the printing unit.

In operation, the proper sized printing unit having plated cylinders suitable for the size of the plate to be printed is selected, and the printing unit is placed between a pair of the ink feeding units disposed facing each other. After the ink feeding units are properly adjusted and rollers of the ink feeding units are in contact with the plate being attached to the plated cylinder of the printing unit to enable the flow of feeding ink, and, thence, the connecting parts have been connected, this device becomes operational and printing can begin in the same manner as that of prior art.

If a different size plate is to be used, the ink feeding units are disengaged and the printing unit removed from therebetween, and another printing unit having the desired standard size of cylinder is placed between the ink feeding units, and printing can begin as previously stated.

For replacement, it is preferable to replace a new plate to the plated cylinder of the printing unit before it has been placed between the ink feeding units. In the present invention, plated and blanket cylinders are designed to be of same the size, and accordingly attachment of the plate and/or replacement of printing units are convenient.

DESCRIPTION OF THE PREFERRED EMBODIMENT

Figure 1:
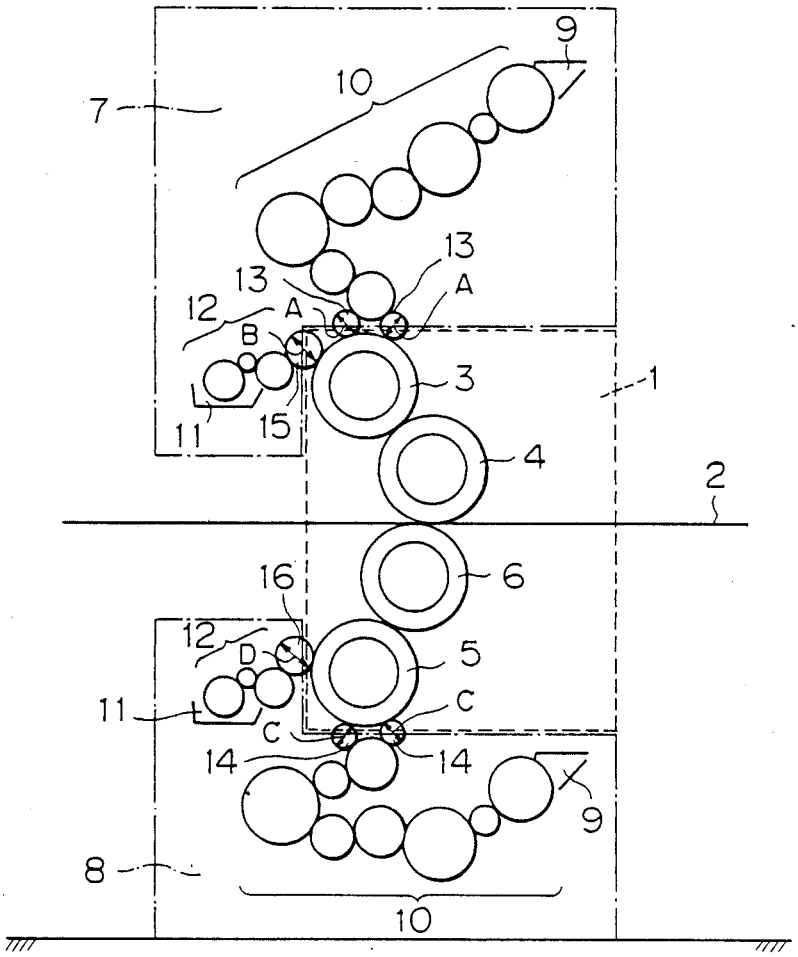
FIG. 1 is a schematic view showing the embodiment of the present invention.

FIG. 1 shows a B-B Typed Printing Press of the preferred embodiment in accordance with the present invention and in which web(s) are fed in a transverse direction.

Printing unit 1 includes a plated cylinder 3 on which a plate (not shown) is affixed which is to print on the surface of web 2, and a blanket cylinder 4 which is in contact with the plated cylinder 3 and transfers ink fed in the plate to web 2, and also includes a plated cylinder 5 on which another plate (not shown) is affixed which is to print on the under surface of web 2, and a blanket cylinder 6 which is in contact with plated cylinder 5 and transfers ink fed in the plate to the under surface of the web. Respective cylinders are in contact with each other and disposed in a longitudinal direction in the following order of plated cylinder 3, blanket cylinder 4, blanket cylinder 6 and plated cylinder 5. The diameter of each of the respective cylinders is the same.

A plurality of printing units are available in each, different, standard size of cylinder and, accordingly, each printing unit has different dimensions.

Figure 2:
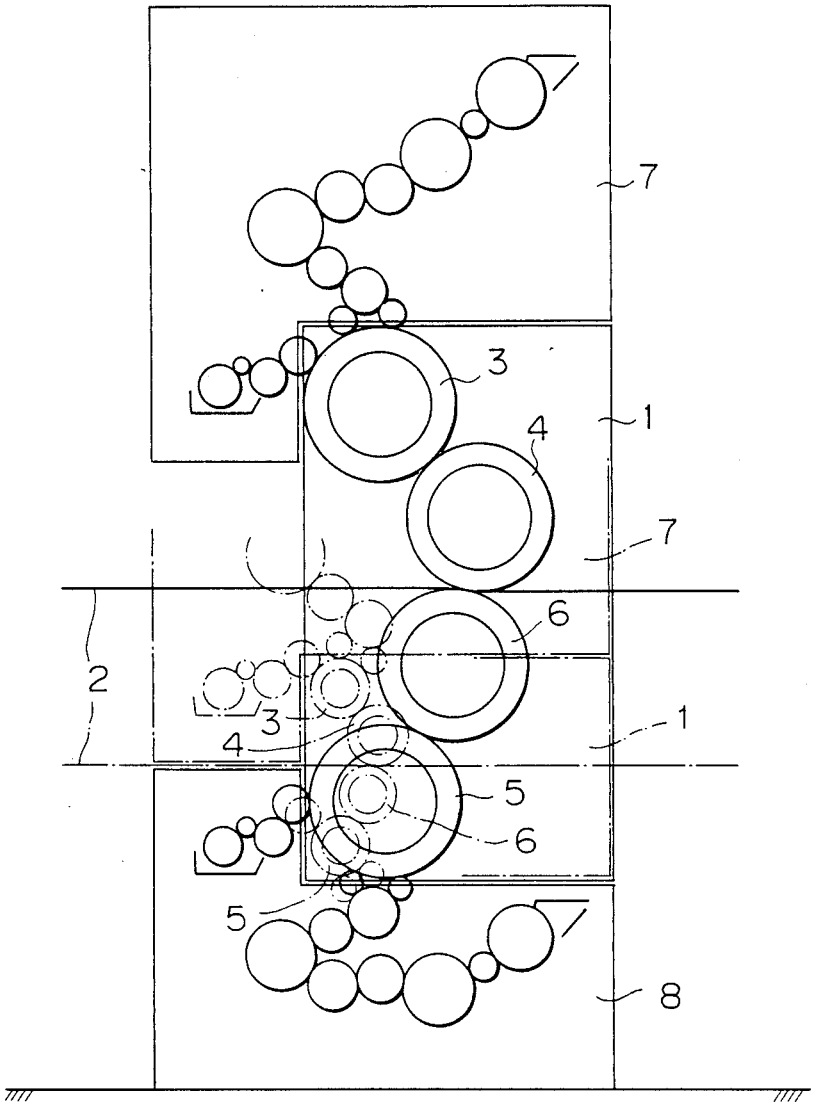
FIG. 2 is a schematic view, same as in FIG. 1, in which application of a different standard size of cylinder to the printing unit is shown.

In order to feed ink to a pair of plates, the pair of ink feeding units 7 and 8, upper and lower, are provided facing each other and said units 7 and 8 are moveable in either an up or down direction so as to secure the selected printing unit having either the largest (shown in solid lines) or smallest (shown in phantom lines) standard size of cylinder therebetween (see FIG. 2). Each ink feeding unit is comprised of a well-known mechanism, namely, an ink fountain 9, one set of ink feed rollers 10, a water fountain 11 and one set of water feed rollers 12.

In order to transfer ink and water from ink feeding units 7 and 8 to plated cylinders 3 and 5 of printing unit 1, ink transfer rollers 13, 14 and water transfer rollers 15 and 16 are constructed in such a manner that both types of rollers may swing as illustrated by the arrows having two heads, arrows A, B and C, D. By this function, ink and water rollers 13 thru 16 are in contact with the plated cylinders 3 and 5, respectively, and the feeding of ink and water are secured when printing unit is being replaced and when plated and blanket cylinders of different standard size are replaced.

As shown in FIG. 1, the ink fountain 9 of the upper feeding unit 7 is in vertical alignment with the ink fountain 9 of the lower feeding unit 8, and also the water fountain 11 of the upper feeding unit 7 is in vertical alignment with the water fountain 11 of the lower feeding unit 8. Accordingly, because of the vertical movement of the upper feeding unit 7 relative to the lower feeding unit 8, as shown in FIG. 2, the vertical alignment between the upper and lower ink fountains 9 and also between the upper and lower water fountains 11 are maintained for all positions of the upper feeding unit 7. It is also noted, that the relationship between the ink and water fountains 9, 11 of the upper feeding unit 7 also is maintained for all positions of the upper feeding unit 7. However, as shown in FIG. 2, the horizontal position of the web 2 does change for each position of the upper feeding unit 7.

The simplicity of construction of this device to accommodate to various sizes of printing by a simple adjustment of the mechanism, its compactness and economical manufacturing cost are possible by merely repositioning the ink feeding unit located at the upper portion by adjustment of the space between ink feeding units 7 and 8.

In accordance with the present invention the space between a pair of ink feeding units is alterable or adjustable and therebetween a printing unit having a different type of standard size of cylinder may be placed and/or removed and accordingly, this printing unit may be utilized for a plate of desired size. Furthermore, in operation this printing unit with little difficulty can always accommodate plates having various sizes from the smallest to the largest.

Moreover, the dimension of each of the plated and blanket cylinders is the same and for this reason the resulting printing can be assured to be without ink stain or variation of color density or hue.

What is claimed is:

1. A web printing press comprising:

a first printing unit disposed between an upper ink feeding unit and a lower ink feeding unit in a vertical arrangement so that said upper and lower ink feeding units face each other;

said first printing unit including upper and lower blanket cylinders for rotatably contacting a horizontally disposed web therebetween for printing on opposite surfaces of said web, and upper and lower plated cylinders being rotatably in contact with said upper and lower blanket cylinders, respectively;

said upper ink feeding unit including an ink fountain, a water fountain and associated ink and water transfer rollers for feeding ink and water respectively to said upper plated cylinder, said ink fountain and said water fountain of said upper ink feeding unit each being disposed in horizontal planes parallel to said web to provide a predetermined vertical distance between said ink fountain and said water fountain of said upper ink feeding unit;

said lower ink feeding unit including an ink fountain, a water fountain and associated ink and water transfer rollers for feeding ink and water respectively to said lower plated cylinder, said ink fountain and said water fountain of said lower ink feeding unit each being disposed in horizontal planes parallel to said web to provide a predetermined vertical distance between said ink fountain and said water fountain of said lower ink feeding unit;

said ink fountain of said upper ink feeding unit being in vertical alignment with said ink fountain of said lower ink feeding unit;

said water fountain of said upper ink feeding unit being in vertical alignment with said water fountain of said lower ink feeding unit;

said blanket cylinders and said plated cylinders each having a diameter of a predetermined size;

said upper plated cylinder being disposed above said upper blanket cylinder, and said lower plated cylinder being disposed below said lower blanket cylinder so that said first printing unit has a predetermined maximum vertical dimension;

first means to permit said first printing unit to be replaced by at least a second printing unit having a predetermined maximum vertical dimension larger than said predetermined maximum vertical dimension of said first printing unit;

said second printing unit including upper and lower blanket cylinders and upper and lower plated cylinders arranged in the same manner as said blanket cylinders and said plated cylinders of said first printing unit;

said blanket cylinders and said plated cylinders of said second printing unit each having a diameter of a predetermined size which is larger than said diameter of each of said blanket cylinders and said plated cylinders of said first printing unit;

second means vertically moving at least one of said ink feeding units from a first position to a second position to provide a larger vertical space between said ink feeding units for receiving said second printing unit between said upper and lower ink feeding units so that said upper and lower ink feeding units continue to face each other in said second position;

said at least one ink feeding unit having the same predetermined vertical distance between said horizontal planes of said ink fountain and said water fountain thereof in both said first and second positions;

said ink fountain of said at least one ink feeding unit moving in a vertical direction from said first position to said second position to maintain said vertical alignment with said ink fountain of the other ink feeding unit when in said second position;

said water fountain of said at least one ink feeding unit moving in a vertical direction from said first position to said second position to maintain said vertical alignment with said water fountain of the other ink feeding unit when in said second position; and said second means vertically moving said at least one ink feeding unit back to said first position for receiving said first printing unit between said upper and lower ink feeding units when replacing said second printing unit;

whereby said web printing press can separately use, one at a time, a plurality of printing units each having a different predetermined maximum vertical dimension.

2. A web printing press according to claim 1, wherein said diameters of said blanket cylinders and said plated cylinders of said first printing unit are equal in size to one another.

3. A web printing press according to claim 2, wherein said diameters of said blanket cylinders and said plated cylinders of said second printing unit are equal in size to one another.

4. A web printing press according to claim 1, wherein said ink and water transfer rollers of said upper and lower ink feeding units are constructed to swing.

5. A web printing press according to claim 4, wherein said diameters of said blanket cylinders and said plated cylinders of said first printing unit are equal in size to one another.

6. A web printing press according to claim 5, wherein said diameters of said blanket cylinders and said plated cylinders of said second printing unit are equal in size to one another.

7. A web printing press according to claim 6, wherein said upper ink feeding unit is movable relative to said lower ink feeding unit so that said web is moved vertically from a first horizontal plane to a second horizontal plane.

8. A web printing press according to claim 1, wherein said upper ink feeding unit is movable relative to said lower ink feeding unit so that said web is moved vertically from a first horizontal plane to a second horizontal plane.

9. A web printing press according to claim 8, including means for swinging said ink and water transfer rollers of said upper ink feeding unit between rotatable contact with said upper plated cylinder of said first printing unit and rotatable contact with said upper plated cylinder of said second printing unit, and means for swinging said ink and water transfer rollers of said lower ink feeding unit between rotatable contact with said lower plated cylinder of said first printing unit and rotatable contact with said lower plated cylinder of said second printing unit.

10. A web printing press according to claim 1, including means for swinging said ink and water transfer rollers of said upper ink feeding unit between rotatable contact with said upper plated cylinder of said first printing unit and rotatable contact with said upper plated cylinder of said second printing unit, and means for swinging said ink and water transfer rollers of said lower ink feeding unit between rotatable contact with said lower plated cylinder of said first printing unit and rotatable contact with said lower plated cylinder of said second printing unit.

* * * * *